US008408793B2

(12) United States Patent
Martuch

(10) Patent No.: US 8,408,793 B2
(45) **Date of Patent: *Apr. 2, 2013**

(54) FLEXIBLE CONTAINER FOR POURABLE PRODUCT

(75) Inventor: Thomas J. Martuch, Augusta, MI (US)

(73) Assignee: Kellogg Company, Battle Creek, MI (US)

( * ) Notice: Subject to any disclaimer, the term of this patent is extended or adjusted under 35 U.S.C. 154(b) by 1333 days.

This patent is subject to a terminal disclaimer.

(21) Appl. No.: 11/835,616

(22) Filed: Aug. 8, 2007

(65) Prior Publication Data

US 2008/0037912 A1 Feb. 14, 2008

Related U.S. Application Data

(60) Provisional application No. 60/821,746, filed on Aug. 8, 2006.

(51) Int. Cl.

| | |
|---|---|
| ***B65D 33/00*** | (2006.01) |
| ***B65D 33/16*** | (2006.01) |
| ***B65D 65/26*** | (2006.01) |
| ***B65D 75/00*** | (2006.01) |
| ***B65D 75/58*** | (2006.01) |

(52) U.S. Cl. .... 383/207; 383/66; 229/87.05; 229/87.08; 426/122

(58) Field of Classification Search ..... 383/200, 383/208, 209, 41, 66, 205, 207; 229/87.05, 229/87.08; 426/122, 123

See application file for complete search history.

(56) References Cited

U.S. PATENT DOCUMENTS

| | | | | | |
|---|---|---|---|---|---|
| 1,714,121 | A | * | 5/1929 | Barbieri | 229/400 |
| 2,132,966 | A | * | 10/1938 | O'Brien | 426/110 |
| 2,210,302 | A | * | 8/1940 | Petter | 229/101.1 |
| 2,779,462 | A | * | 1/1957 | Hoag | 206/45.24 |
| 2,952,394 | A | * | 9/1960 | Schneider | 229/113 |
| 3,074,612 | A | * | 1/1963 | Schneider | 426/85 |
| 3,404,988 | A | * | 10/1968 | Rausing | 426/115 |
| 3,790,744 | A | | 2/1974 | Bowen | |
| 3,909,582 | A | | 9/1975 | Bowen | |
| 3,967,773 | A | * | 7/1976 | Kaufmann | 229/101.1 |
| 4,091,929 | A | * | 5/1978 | Krane | 229/101.1 |
| 4,139,643 | A | | 2/1979 | Hix et al. | |
| 4,546,884 | A | | 10/1985 | Kuchenbecker | |
| 4,609,107 | A | | 9/1986 | Martin et al. | |
| 4,666,044 | A | * | 5/1987 | Farber | 229/237 |
| 4,740,163 | A | | 4/1988 | Kuchenbecker | |
| 4,762,233 | A | * | 8/1988 | Sears et al. | 229/101.2 |
| 4,762,514 | A | | 8/1988 | Yoshida | |
| 4,779,738 | A | * | 10/1988 | Akutsu et al. | 229/202 |
| 4,816,015 | A | | 3/1989 | Holder et al. | |

(Continued)

FOREIGN PATENT DOCUMENTS

| | | | |
|---|---|---|---|
| EP | 0473517 | A2 | 3/1992 |
| EP | 0540184 | A1 | 5/1993 |

*Primary Examiner* — Jes F Pascua
*Assistant Examiner* — Peter Helvey
(74) *Attorney, Agent, or Firm* — Dickinson Wright PLLC

(57) ABSTRACT

A flexible container for containing a quantity of pourable product is disclosed herein. The flexible container includes a bag having a first closed end and a second closed end and a wall extending between the first closed end and the second closed end to define a closed cavity. The flexible container also includes a plurality of tearable score lines in the bag spaced from one another to define a plurality of differently configured intended openings in the bag.

12 Claims, 3 Drawing Sheets

U.S. PATENT DOCUMENTS 4,890,759 A 1/1990 Scanga et al.
4,951,836 A 8/1990 Yoshimura et al.
5,029,712 A 7/1991 O'Brien et al.
5,042,666 A * 8/1991 Dolenc ..... 383/209
5,048,687 A * 9/1991 Suzuki et al. ..... 206/497
5,125,211 A 6/1992 O'Brien et al.
5,158,499 A 10/1992 Guckenberger
5,163,558 A * 11/1992 Palumbo et al. ..... 206/494
5,174,658 A 12/1992 Cook et al.
5,205,479 A 4/1993 Rice et al.
5,248,040 A * 9/1993 DeMatteis et al. ..... 206/554
5,267,795 A * 12/1993 Bernstein et al. ..... 383/88
5,312,189 A * 5/1994 Aeschbach et al. ..... 383/207
5,318,499 A 6/1994 Rice et al.
5,326,023 A 7/1994 Rice et al.
5,333,729 A 8/1994 Wolfe
5,348,399 A * 9/1994 DeMatteis ..... 383/209
5,375,930 A * 12/1994 Tani ..... 383/206
5,376,392 A 12/1994 Ikegami et al.
5,443,154 A 8/1995 Hustad et al.
5,484,100 A * 1/1996 Rigby ..... 229/101.1
5,494,215 A 2/1996 Drummond et al.
5,529,224 A 6/1996 Chan et al.
5,547,451 A 8/1996 Drummond et al.
5,579,989 A 12/1996 Roy et al.
5,601,369 A * 2/1997 Moseley et al. ..... 383/209
5,611,626 A * 3/1997 Warr ..... 383/10
5,630,308 A 5/1997 Guckenberger
5,632,134 A 5/1997 Noel et al.
5,688,463 A 11/1997 Robichaud et al.
5,692,837 A 12/1997 Beer
5,744,289 A * 4/1998 Kobayashi et al. ..... 430/465
5,783,266 A 7/1998 Gehrke
5,810,706 A 9/1998 McDonald et al.
5,820,017 A 10/1998 Eliovson et al.
5,826,752 A 10/1998 Latimer
5,874,155 A 2/1999 Gehrke et al.
5,934,809 A * 8/1999 Marbler ..... 383/208
5,937,617 A 8/1999 Yeager
5,996,845 A 12/1999 Chan
6,007,246 A 12/1999 Kinigakis et al.
6,010,001 A 1/2000 Osborn, III
6,062,470 A 5/2000 Robichaud
6,073,833 A 6/2000 Desrosiers et al.
6,074,097 A 6/2000 Hayashi et al.
6,076,969 A 6/2000 Jaisle et al.
6,082,897 A 7/2000 Galomb
6,098,874 A 8/2000 Tokarski
6,120,860 A 9/2000 Bowen et al.
6,126,975 A 10/2000 Archibald et al.
6,131,736 A 10/2000 Farris et al.
6,132,089 A 10/2000 Galomb et al.
6,132,780 A 10/2000 Archibald et al.
6,139,187 A 10/2000 Galomb et al.
6,148,587 A 11/2000 McDonald et al.
6,173,554 B1 1/2001 Marbler
6,207,925 B1 3/2001 Kendall
6,231,235 B1 5/2001 Galomb et al.
6,234,676 B1 5/2001 Galomb et al.
6,237,760 B1 5/2001 Parker et al.
6,241,646 B1 6/2001 Tokarski
6,245,367 B1 6/2001 Galomb
6,254,273 B1 7/2001 Galomb et al.
6,254,907 B1 7/2001 Galomb
6,257,763 B1 7/2001 Stolmeier et al.
6,273,607 B1 8/2001 Buchman
6,273,608 B1 8/2001 Ward, Jr. et al.
6,276,243 B1 8/2001 Jenkins
6,290,390 B1 9/2001 Buchman
6,290,391 B1 9/2001 Buchman
6,296,388 B1 10/2001 Galomb et al.
6,299,607 B1 10/2001 Osborn, III et al.
6,328,203 B1 12/2001 Tedford, Jr.
6,347,885 B1 2/2002 Buchman
6,352,364 B1 3/2002 Mobs
6,360,513 B1 3/2002 Strand et al.
6,383,592 B1 5/2002 Lowry et al.
6,390,676 B1 5/2002 Colombo et al.
6,394,340 B1 5/2002 Anchor et al.
6,415,939 B1 7/2002 Redmond
6,419,152 B1 7/2002 Tokarski
6,427,420 B1 8/2002 Olivieri et al.
6,446,860 B1 9/2002 Robichaud
6,454,692 B2 9/2002 Ganneval et al.
6,460,759 B1 10/2002 Lowry et al.
6,464,394 B1 10/2002 Galomb
6,467,956 B1 10/2002 Tilman et al.
6,474,866 B2 11/2002 Buchman
6,502,986 B1 1/2003 Bensur et al.
6,517,242 B1 2/2003 Buchman
6,517,243 B2 2/2003 Huffer et al.
6,524,002 B2 2/2003 Tomic
6,530,870 B2 3/2003 Buchman et al.
6,554,135 B1 4/2003 Luceri et al.
6,558,306 B2 5/2003 Lowry et al.
6,572,266 B2 6/2003 Buchman
6,588,177 B1 7/2003 Melchoir
6,595,353 B1 7/2003 Focke et al.
6,601,370 B2 8/2003 Colombo et al.
6,609,999 B2 8/2003 Albright
6,610,338 B2 8/2003 Tang
6,652,436 B1 11/2003 Yeager et al.
6,660,983 B2 * 12/2003 Monforton et al. ..... 219/727
6,675,558 B2 1/2004 Kinigakis et al.
6,685,058 B2 2/2004 Redmond
6,688,079 B2 2/2004 Kinigakis et al.
6,688,080 B2 2/2004 Kinigakis et al.
6,688,515 B1 2/2004 Huffman et al.
6,705,467 B1 3/2004 Kancsar et al.
6,709,157 B2 3/2004 VandenHeuvel et al.
6,719,678 B1 4/2004 Stern
6,726,363 B1 4/2004 Marbler et al.
6,746,743 B2 6/2004 Knoerzer et al.
6,766,941 B1 7/2004 Tokarski
6,769,229 B2 8/2004 Kinigakis et al.
6,811,027 B2 11/2004 Alexander
6,820,393 B2 11/2004 Kinigakis et al.
6,820,745 B1 11/2004 Ono et al.
6,823,647 B2 11/2004 Kinigakis et al.
6,829,873 B2 12/2004 Kinigakis et al.
6,843,600 B2 1/2005 Tilman et al.
6,845,598 B1 1/2005 Melchoir
6,860,843 B2 3/2005 Hayashi et al.
6,863,646 B2 3/2005 Kinigakis et al.
6,866,420 B2 3/2005 Buchman
6,874,935 B2 4/2005 Edelman et al.
6,880,973 B2 4/2005 Schneider et al.
6,884,207 B2 4/2005 Pokusa
6,892,876 B1 5/2005 Aubry et al.
6,910,806 B2 6/2005 Strand et al.
6,913,387 B2 7/2005 Strand et al.
6,929,128 B2 8/2005 Caldwell et al.
6,935,996 B2 8/2005 Stern
6,939,041 B2 9/2005 Kinigakis et al.
6,945,922 B2 9/2005 Baggot et al.
6,948,848 B2 9/2005 Ausnit
6,951,999 B2 * 10/2005 Monforton et al. ..... 219/727
6,957,763 B2 * 10/2005 Huffman et al. ..... 229/125.08
6,964,520 B1 * 11/2005 Sakai et al. ..... 383/207
6,971,794 B2 12/2005 Yeager
6,974,256 B2 12/2005 Kinigakis et al.
6,983,576 B2 1/2006 Ono et al.
6,986,377 B2 1/2006 Johnson et al.
6,988,828 B2 1/2006 Linneweil
6,994,470 B2 2/2006 Galomb
2001/0017947 A1 8/2001 Strand et al.
2001/0017950 A1 8/2001 Strand et al.
2001/0019989 A1 9/2001 Ganneval et al.
2001/0030192 A1 10/2001 Redmond
2001/0053253 A1 12/2001 Buchman et al.
2002/0015537 A1 2/2002 Strand et al.
2002/0040213 A1 4/2002 Tweddell, III et al.
2002/0068668 A1 6/2002 Chow et al.
2002/0102032 A1 * 8/2002 Sturgis et al. ..... 383/10
2002/0154835 A1 10/2002 Galomb
2002/0196987 A1 12/2002 Tilman et al.
2003/0002753 A1 1/2003 Stolmeier et al.

2003/0019780 A1 1/2003 Parodi et al.
2003/0041563 A1 3/2003 Schneider et al.
2003/0051440 A1* 3/2003 Chow et al. ..... 53/412
2003/0054931 A1 3/2003 Buchman et al.
2003/0072502 A1 4/2003 Strand et al.
2003/0077010 A1 4/2003 Schulz
2003/0113415 A1 6/2003 Strand et al.
2003/0116614 A1* 6/2003 Block et al. ..... 229/146
2003/0124294 A1 7/2003 Hodson et al.
2003/0127352 A1 7/2003 Buschkiel et al.
2003/0172622 A1 9/2003 Kinigakis et al.
2003/0185468 A1 10/2003 Keith et al.
2003/0198407 A1 10/2003 Rehwinkel et al.
2003/0203799 A1 10/2003 VandenHeuvel et al.
2003/0215163 A1 11/2003 Schneider et al.
2003/0219173 A1 11/2003 Schneider
2003/0219176 A1 11/2003 Kocher et al.
2003/0231811 A1 12/2003 Hodson et al.
2004/0026423 A1 2/2004 Cappel et al.
2004/0035719 A1 2/2004 Ebbers et al.
2004/0038792 A1* 2/2004 Albright ..... 493/309
2004/0058039 A1 3/2004 Strand et al.
2004/0060974 A1 4/2004 Dacey
2004/0086207 A1 5/2004 Marbler et al.
2004/0089577 A1 5/2004 Kancsar et al.
2004/0109618 A1 6/2004 Marbler et al.
2004/0114838 A1 6/2004 McGregor
2004/0118839 A1 6/2004 Hughes et al.
2004/0118904 A1 6/2004 Versluys
2004/0134166 A1 7/2004 Ausnit
2004/0141664 A1 7/2004 Olsen et al.
2004/0146226 A1 7/2004 Wolak et al.
2004/0208400 A1 10/2004 Linneweil
2004/0228547 A1 11/2004 Hartzell et al.
2005/0008268 A1 1/2005 Plourde et al.
2005/0016125 A1 1/2005 Kinigakis et al.
2005/0016134 A1 1/2005 Prebelli et al.
2005/0017007 A1 1/2005 Sellari et al.
2005/0025392 A1 2/2005 Stolmeier
2005/0025395 A1 2/2005 Howell et al.
2005/0029267 A1 2/2005 Martin et al.
2005/0031228 A1 2/2005 Galomb et al.
2005/0031232 A1 2/2005 Jammet et al.
2005/0041889 A1 2/2005 Scarberry
2005/0050851 A1 3/2005 Osgood
2005/0053315 A1 3/2005 Aasen
2005/0061701 A1 3/2005 Osgood
2005/0063617 A1 3/2005 Tilman
2005/0063619 A1 3/2005 Kinigakis et al.
2005/0084186 A1 4/2005 Caris
2005/0103681 A1 5/2005 Aubry et al.
2005/0123218 A1 6/2005 Pokusa
2005/0132668 A1 6/2005 Ausnit
2005/0135710 A1 6/2005 Melchoir
2005/0137073 A1 6/2005 Weaver
2005/0150785 A1 7/2005 Julius et al.
2005/0150891 A1 7/2005 Schalk et al.
2005/0160700 A1 7/2005 Zumbiel et al.
2005/0178087 A1 8/2005 Melchoir
2005/0184070 A1 8/2005 Boback et al.
2005/0187089 A1 8/2005 Schneider et al.
2005/0189353 A1 9/2005 Padovani
2005/0194282 A1 9/2005 Kraimer et al.
2005/0199521 A1 9/2005 Givens, Jr.
2005/0226542 A1 10/2005 Kendall et al.
2005/0252176 A1 11/2005 Pritchard
2005/0254731 A1 11/2005 Berbert et al.
2005/0276521 A1 12/2005 Price
2005/0276525 A1 12/2005 Hebert et al.
2005/0284776 A1 12/2005 Kobayashi et al.
2005/0284789 A1 12/2005 Carespodi
2006/0014616 A1 1/2006 Baggot et al.
2006/0021296 A1 2/2006 Yeager
2006/0027483 A1 2/2006 Aldridge
2006/0034551 A1 2/2006 Linneweil
2008/0037912 A1* 2/2008 Martuch ..... 383/205
2008/0037913 A1* 2/2008 Martuch ..... 383/205

* cited by examiner

FLEXIBLE CONTAINER FOR POURABLE PRODUCT

CROSS-REFERENCE TO RELATED APPLICATION

This application claims the benefit of U.S. Provisional Patent Application Ser. No. 60/821,746 for a FLEXIBLE CONTAINER FOR POURABLE PRODUCT, filed on Aug. 8, 2006, which is hereby incorporated by reference in its entirety.

BACKGROUND OF THE INVENTION

1. Field of the Invention

The inventions relate to a flexible container for containing a quantity of pourable product, such as a bag or pouch or sack, having a removable portion for defining an intended opening.

2. Description of the Related Art

Packages constructed from flexible materials such as laminates can be used to contain products that are pourable, such as liquids and powders. Other examples of the pourable products contained in packages constructed from flexible materials include discrete masses packaged, such as food products, plastic pellets, and gravel. With respect to pourable, edible products, at least some are placed in hermetically sealed pouches to preserve their freshness. These packages can include an opening for gaining access to the package interior. The opening can be defined by a portion of the package that is removed from the rest of the packaged. The "removed" portion can be engaged with the rest of the package along a score line or "line of weakness."

SUMMARY OF THE INVENTION

In summary, the invention is a flexible container for containing a quantity of pourable product. The flexible container includes a bag having a first closed end and a second closed end and a wall extending between the first closed end and the second closed end to define a closed cavity. The flexible container also includes a plurality of tearable score lines in the bag spaced from one another to define a plurality of differently configured intended openings in the bag.

DETAILED DESCRIPTION OF EXEMPLARY EMBODIMENTS

Figure 1:
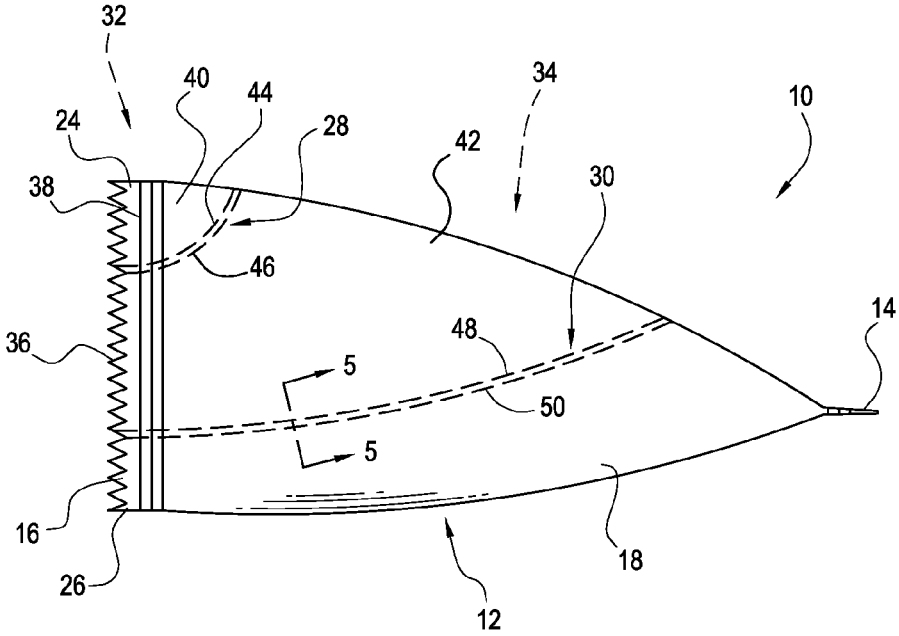
FIG. 1 is a front view of a first flexible container according to an embodiment of the invention.

A plurality of different flexible containers are shown in the Figures of the application. Similar features are shown in the various flexible containers. Similar features have been numbered with a common reference numeral and have been differentiated by an alphabetic designation. Also, to enhance consistency, features in any particular drawing share the same alphabetic designation even if the feature is shown in less than all of the flexible containers. Similar features are structured similarly, operate similarly, and/or have the same function unless otherwise indicated by the drawings or this specification. Furthermore, particular features of one flexible container can replace corresponding features in another flexible container unless otherwise indicated by the drawings or this specification.

Figure 2:
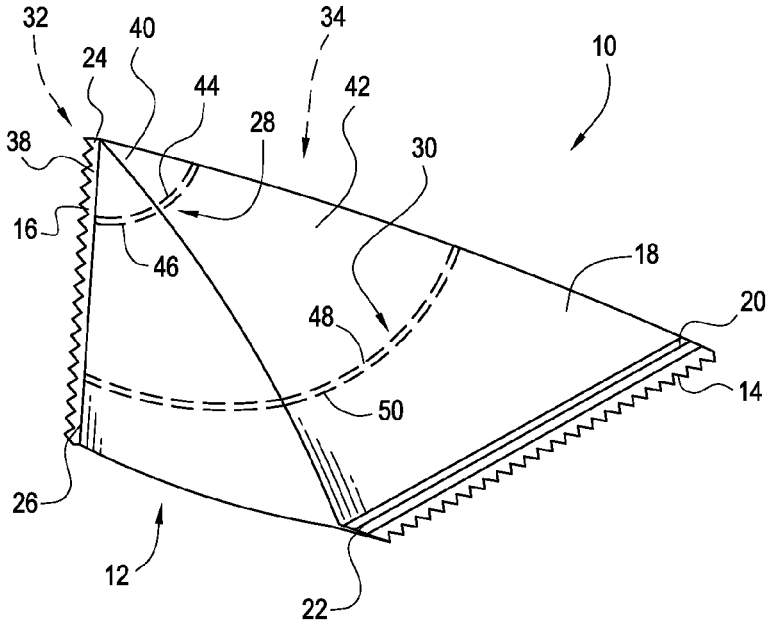
FIG. 2 is a perspective view of the first flexible container.

FIGS. 1 and 2 show a first flexible container 10 for containing a quantity of pourable product. FIG. 1 is front view; the rear view of the flexible container 10 is identical, but mirrored. The pourable product can be a liquid, a powder, a plurality of discrete pieces, or any combination thereof. The pourable product can be food product or non-edible product. With respect to possible alternative pourable food products, the pourable product in the first flexible container 10 can be a liquid such as ketchup or sauce or cream cheese, or a powder such as salt or pepper or other spices, or a plurality of discrete pieces such as candy pieces or crackers or potato chips. These exemplary pourable food products are set forth as examples and illustrations and not as limitations.

The first flexible container 10 is in the form of a bag 12. As used herein, "bag" refers to any flexible container operable to hold a pourable product such as, by example and not limitation, a potato-chip style bag, a condiment packet, a fruit/vegetable sac, or a rock salt style bag. Alternative embodiments of the first flexible container 10 can take the form of a packet or a pouch or a sack. The bag 12 has a first closed end 14 and a second closed end 16 and a wall 18. The wall 18 extends between the first closed end 14 and the second closed end 16 to define a closed cavity. The bag 12 includes four corners 20, 22, 24, 26 defined at the first and second ends 14, 16. Alternative embodiments of the invention may include a bag having two corners at one end and an opposite end being rounded or two rounded ends.

The first flexible container 10 also includes a plurality of tearable score lines 28, 30 spaced from one another to define a plurality of differently configured intended openings 32, 34 in the bag 12. In alternative embodiments of the invention, the plurality of score lines may include more than two score lines to define more than two intended openings in the bag. In the first flexible container 10, the opening 32 is a pour spout and the opening 34 is a display opening. The leader lines extending from the numerals 32 and 34 are dashed in FIGS. 1 and 2 because material has not been separated from the bag 12 to define the openings 32, 34.

The score line 28 extends about a portion 38 of the second closed end 16 to isolate the portion 38 from a first remainder of the bag 12. The corner 24 is included with the portion 38 of the second closed end 16. The score line 28 also extends about a portion 40 of the wall 18. The first remainder of the bag 12 remains after the portions 38 and 40 have been removed. The path followed by the score line 28 defines the first intended opening to the closed cavity, the pour spout 32.

The score line 30 is spaced from the score line 28 and extends about a portion 42 of the wall 18 to isolate the portion 42 from a second remainder of the bag 12. The score line 30 also extends about a portion 36 of the second closed end 16. The second remainder of the bag 12 remains after the portions 36, 38, 40 and 42 have been removed. The path followed by the score line 30 defines the second intended opening to the closed cavity, a display opening 34. The display opening 34 is larger than the pour spout opening 32. When the display opening 34 is formed, the portions 38, 40 which define the pour spout 32 are also removed from the bag 12. Both of the score lines 28 and 30 extend along endless paths, defining complete circles.

The first flexible container 10 can be opened in several ways. Either closed end 14, 16 may be opened to gain access to the pourable product in the closed cavity. Alternatively, either the pour spout 32 or the display opening 34 can be opened. For example, if the user of the first flexible container 10 desires to pour the pourable product from the first flexible container 10, the user can directly grasp the corner 24 with one hand and directly grasp the portion 36 of the second closed end 16 with the other hand and twist the corner 24 and the portion 36 relative to one another. The twisting will cause the bag 12 to tear along the score line 28 and separate the corner 24 from the first remainder of the bag 12, thus defining the pour spout opening 32.

Alternatively, if the user of the first flexible container 10 desires to expose the pourable product in the first flexible container 10, the first flexible container 10 can function like a serving dish, such as a bowl or platter. The user can directly grasp the portion 36 with one hand and directly grasp the corner 26 with the other hand and twist the portion 36 and the corner 26 relative to one another. The twisting will cause the bag 12 to tear along the score line 30 and separate both the corner 24 and the portion 42 from the second remainder of the bag 12, thus defining the display opening 34.

As result, the first flexible container 10 allows a user to use and/or consume the pourable product in different ways. The pour spout 32 can be a desirable opening if the user will be holding the first flexible container 10. The display opening 34 can be a desirable opening if the first flexible container 10 is placed on a surface. Furthermore, the first flexible container 10 allows a user to use and/or consume the pourable product in different ways during use and/or consumption. For example, the pour spout 32 can be opened initially and then the display opening 34 can be opened subsequently if the conditions of use and/or consumption change.

Each of the score lines 28, 30 include a pair of sub-score lines to enhance control over the tear of the bag 12. For example, the score line 28 includes a primary score line 44 and back-up score line 46. The lines 44, 46 are closely spaced to one another and extend substantially parallel to one another. The line 44 is the intended line of tear. However, during tearing, the line of tear may depart from the line 44. In such a circumstance, the line of tear will intersect the line 46 and follow the line 46. As a result, the likelihood of over-tearing is reduced.

Figure 5:
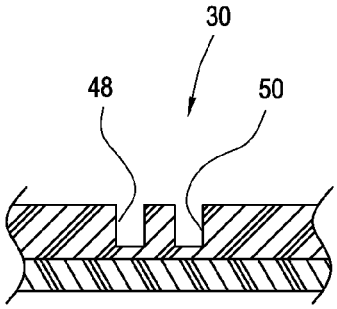
FIG. 5 is a detail view of a second score line from the perspective of arrows 5-5 in FIG. 1.

FIG. 5 shows an embodiment of the score line 30. The bag 12 is formed from plastic and is multi-laminate. The score line 30 includes a primary score line 48 and back-up score line 50. The lines 48 and 50 can be formed with a die or with a laser or with any other score line-forming method/device known in the art. The exemplary lines 48 and 50 do not extend completely through the bag 12 to increase the likelihood that the pourable product in the bag 12 will remain fresh.

Figure 3:
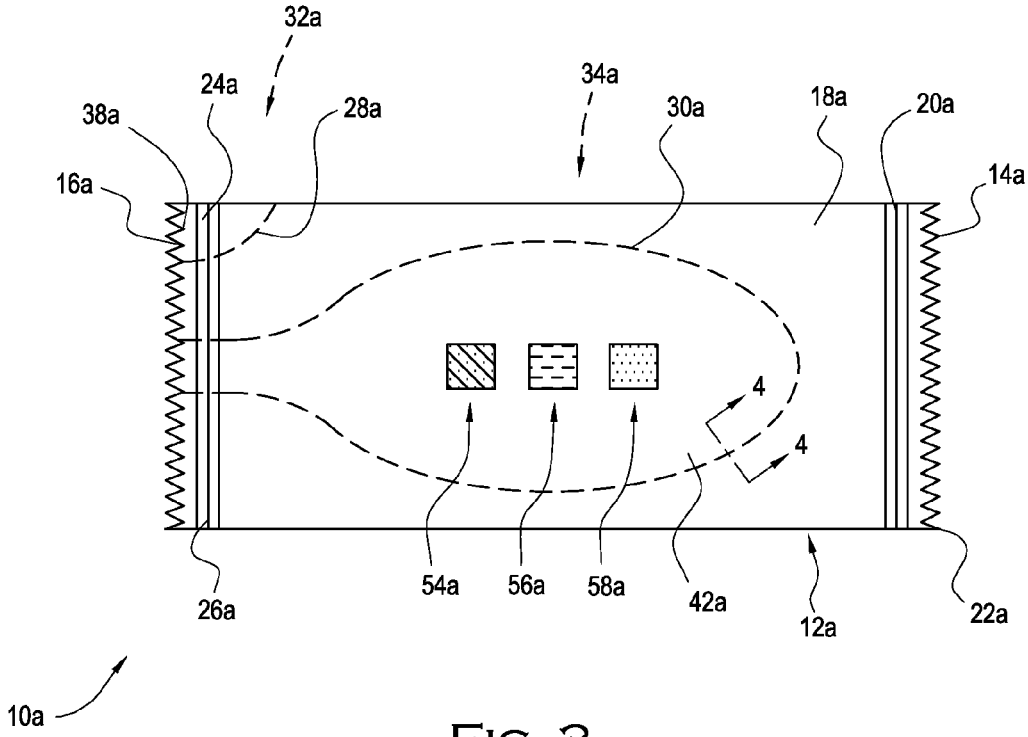
FIG. 3 is a top view of a second flexible container according to an embodiment of the invention.
Figure 4:
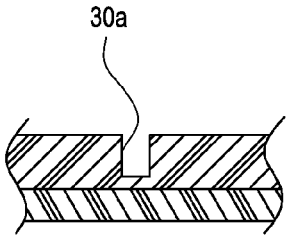
FIG. 4 is a detail view of a first score line from the perspective of arrows 4-4 in FIG. 3.

In the first flexible container 10, the second score line 30 encircles the first score line 28. FIGS. 3 and 4 show a second flexible container 10*a* in the form of a packet 12*a* having a different arrangement of score lines. The second flexible container 10*a* is operable to contain a quantity of pourable product, such as powder 54*a*, a liquid 56*a*, a plurality of discrete pieces 58*a*, or any combination thereof. A "liquid" includes any non-solid material regardless of viscosity. The packet 12*a* with a first closed end 14*a* and a second closed end 16*a* and a wall 18*a*. The wall 18*a* extends between the first closed end 14*a* and the second closed end 16*a* to define a closed cavity. The packet 12*a* includes four corners 20*a*, 22*a*, 24*a*, 26*a* defined at the first and second ends 14*a*, 16*a*. The second flexible container 10*a* also includes a plurality of tearable score lines 28*a*, 30*a* spaced from one another to define a plurality of differently configured intended openings 32*a*, 34*a* in the packet 12*a*. In the second flexible container 10*a*, the opening 32*a* is a pour spout and the opening 34*a* is a display opening. Only the score line 28*a* extends along an endless path to define a complete circle. The score line 30*a* includes an appreciable starting point and ending point, both disposed along the end 16*a*.

The first and second flexible containers 10, 10*a* demonstrate that the teachings of this application can be practiced in numerous ways. For example, in the first flexible container 10, the openings 32, 34 overlap since the score line 30 encircles the score line 28. In the second flexible container 10*a*, the score lines 28*a*, 30*a* do not overlap. As a result, a portion 38*a* can be retained with respect to the bag 12*a* while the portion 42*a* is removed from the bag 12*a*. The portions 38*a* and 42*a* are spaced from one another. In addition, the first end closed 14*a* extends substantially parallel to said second closed end 16*a* in the second flexible container 10*a*. The first closed end 14 extends substantially perpendicular to the second closed end 16 in the first flexible container 10.

Figure 6:
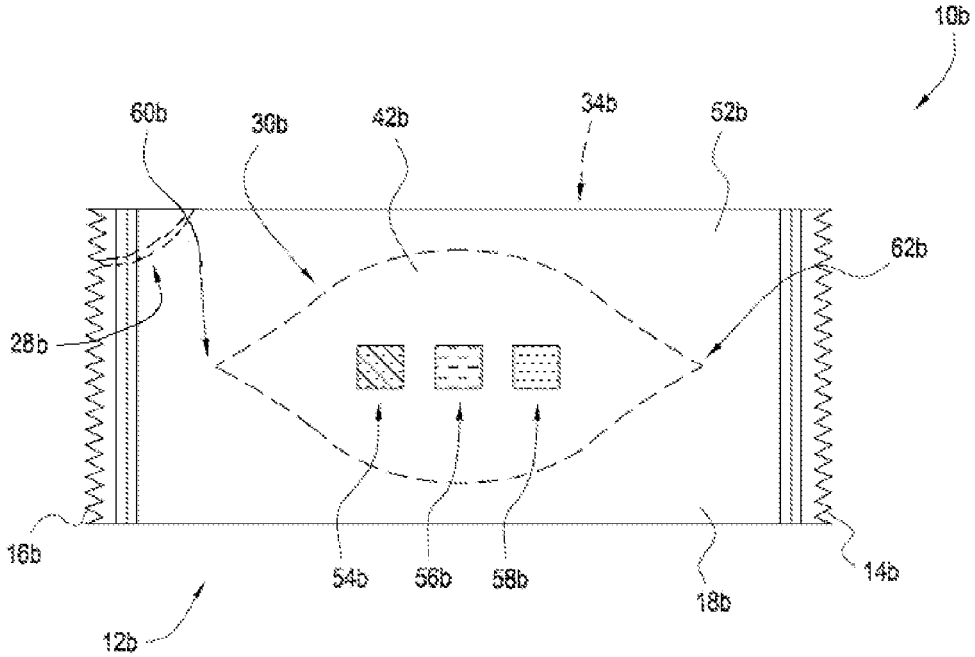
FIG. 6 is a top view of a third flexible container according to an embodiment of the invention.

FIG. 6 shows a third flexible container 10*b* operable to contain a quantity of pourable product, such as powder 54*b*, a liquid 56*b*, a plurality of discrete pieces 58*b*, or any combination thereof. The flexible container 10*b* includes a bag 12*b* having a first closed end 14*b* and a second closed end 16*b* extending substantially parallel to the first closed end 14*b*. The bag 12*b* also includes a wall 18*b* extending between the first closed end 14*b* and the second closed end 16*b* to define a closed cavity.

The bag 12*b* also includes a tearable score lines 28*b*, 30*b* defining an intended openings directly to the closed cavity. The score line 30*b* divides the wall 18*b* into a first portion 52*b* engaged with both of the first closed end 14*b* and the second closed end 16*b* and a second portion 42*b* spaced from both of the first closed end 14*b* and the second closed end 16*b*. The tearable score line 30*b* is exposed and directly graspable. The tearable score line 30*b* extends along a closed path and is exposed along all of the closed path. The tearable score line 30*b* is the only link between the first portion 52*b* and the second portion 42*b*. As a result, the bag 12*b* can be permanently converted into a serving dish such a bowl or a platter. The bag 12*b* requires no extraneous overlay or other link between the portions 42*b*, 52*b*, to render the portion 42*b* a re-closable lid member to the bag 12*b*, making the bag 12*b* less costly and easier to open than bags in the prior art.

As set forth above, the flexible container 10*b* can contain a pourable food product. If the food product is a liquid, the liquid is flowable through an aperture formed when the tearable score line 30*b* is torn and the second portion 42*b* is permanently separated from the first portion 52*b*. In one example, the bag 12*b* may contain a quantity of ketchup desirable for an event, such as a picnic. Instead of transporting a large plastic bottle of ketchup, a user may acquire a bag 12*b* with a smaller quantity of ketchup. The bag 12*b* can be opened like a serving dish by removing the portion 42*b* from the portion 52*b*, the ketchup evacuated from the bag 12*b* through a display opening 34*b* during the event, and the bag 12*b* disposed after the event.

If the quantity of pourable food product is a plurality of discrete pieces, the second portion 42*b* can be larger than each of the plurality of discrete pieces. In one example, the bag 12*b* may contain a quantity of potato chips desirable for an event, such as a party. The portion 42*b* can be sized to allow a user to grasp a plurality of potato chips at one time and evacuate the potato chips from the bag 12*b*.

The path followed by the tearable score line 30*b* includes first and second hastate portions 60*b*, 62*b*. Alternative embodiments of the invention may only include one hastate portion or may not include a single hastate portion. The hastate portions 60*b*, 62*b* provide locations to initiate a tear of the score line 30*b*. A user of the bag 12*b* can grasp one side of the score line 30*b*, the portion 52*b*, with one hand and grasp the other side of the score line 30*b*, the portion 42*b*, with the other hand. Pinching the grasped portions 42*b* and 52*b* and pulling apart can result in the score line 30*b* being torn.

Figure 7:
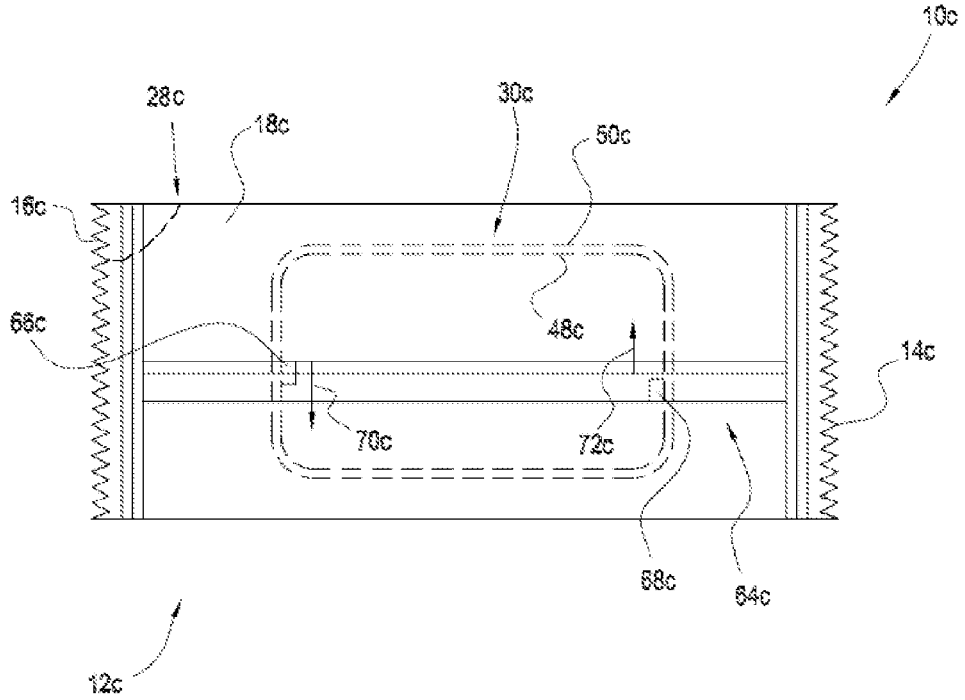
FIG. 7 is a bottom view of a fourth flexible container according to an embodiment of the invention.

FIG. 7 shows a fourth flexible container 10*c* operable to contain a quantity of pourable product. The flexible container 10*c* is the form of a bag 12*c* having a first closed end 14*c* and a second closed end 16*c* extending substantially parallel to the first closed end 14*c*. The bag 12*c* also includes a wall 18*c* extending between the first closed end 14*c* and the second closed end 16*c* to define a closed cavity. The bag 12*c* also includes a tearable score lines 28*c*, 30*c* defining an intended opening directly to the closed cavity. The tearable score line 30*c* includes a primary score line 48*c* and back-up score line 50*c* closely spaced to one another and extending substantially parallel to one another.

The flexible container 10*c* also includes a longitudinal seam 64*c* closing the wall 18*c* transverse to the first closed end 14*c* and the second closed end 16*c*. The tearable score line 30*c* crosses the longitudinal seam 64*c*. Thus, the score line 30*c* is disposed on the side of the bag 12*c* that is generally the back side. First and second tabs 66*c*, 68*c* are formed in the longitudinal seam 64*c*. The tabs 66*c*, 68*c* are contiguous with the tearable score line 30*c* and can be engaged to initiate a tear in the score line 30*c*. The tabs 66*c*, 68*c* can be aligned with the primary score line 48*c* and can be helpful to accomplish complete tearing of the score line 30*c* across the seam 64*c*. The tab 66*c* can be pulled in a direction 70*c* to tear the score line 30*c* across the seam 64*c* and the tab 68*c* can be pulled in a direction 72*c* to tear the score line 30*c* across the seam 64*c*.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What can be claimed is:

1. A flexible container for containing a quantity of pourable product comprising:

a bag having a first closed end and a second closed end and a wall extending between said first closed end and said second closed end to define a closed cavity; and a plurality of tearable score lines in said bag extending along endless paths and spaced from one another to define a plurality of differently configured intended openings in said bag;

at least one of said plurality of tearable score lines having a primary score line and back-up score line closely spaced to one another and extending substantially parallel to one another, wherein each of said primary score line and said back-up score line extend along an endless path in an outer surface of said bag;

wherein said plurality of tearable score lines include a first score line extending about a corner of said bag, including a first portion of one of said first and second ends and a first portion of said wall, to define a pour spout for pouring the pourable product from the flexible container, and a second score line spaced from said first score line and extending around at least a second portion of said wall and a second portion of one of said first and second ends to define a display opening for exposing the pourable product in the flexible container.

2. The flexible container of claim 1 wherein second portion of said wall is larger than said first portion such that said second intended opening is larger than said first intended opening.

3. The flexible container of claim 1 wherein said second score line is further defined as extending around at least a second portion of one of said first and second ends.

4. The flexible container of claim 1 wherein said second score line is further defined as spaced from both of said first and second ends.

5. The flexible container of claim 1 wherein said second score line encircles said first score line.

6. The flexible container of claim 1 wherein both of said first and second score lines extend along endless paths to completely encircle first and second portions of said bag.

7. The flexible container of claim 1 wherein only one of said first and second score lines extends along an endless path to completely encircle a portion of said bag.

8. The flexible container of claim 1 wherein said plurality of intended openings are further defined as being differently sized from one another.

9. The flexible container of claim 1 wherein each of said plurality of score lines includes a primary score line and back-up score line closely spaced to one another and extending substantially parallel to one another.

10. The flexible container of claim 1 wherein said first closed end extends substantially parallel to said second closed end.

11. The flexible container of claim 1 wherein said first end closed extends substantially perpendicular to said second closed end.

12. The flexible container of claim 1 further comprising:

a quantity of at least one of powder, liquid, and discrete pieces.

* * * * *